US007635325B2

(12) United States Patent
Chiang et al.

(10) Patent No.: US 7,635,325 B2
(45) Date of Patent: Dec. 22, 2009

(54) INTERACTIVE TRAINING DEVICE

(75) Inventors: Tzu-Peng Chiang, Taichung (TW); Wei-Long Chen, Taichung (TW); Chia-Chang Chang, Taichung (TW)

(73) Assignee: Cycling and Health Tech Industry Research & Development Center, Taichung (TW)

( * ) Notice: Subject to any disclaimer, the term of this patent is extended or adjusted under 35 U.S.C. 154(b) by 0 days.

(21) Appl. No.: 12/150,870

(22) Filed: May 1, 2008

(65) Prior Publication Data

US 2009/0275451 A1 Nov. 5, 2009

(51) Int. Cl.
*A63B 22/14* (2006.01)
*A63B 22/16* (2006.01)

(52) U.S. Cl. ..... 482/146; 482/34

(58) Field of Classification Search ..... 482/146, 482/34, 147, 79–80, 139
See application file for complete search history.

(56) References Cited

U.S. PATENT DOCUMENTS

| | | | | |
|---|---|---|---|---|
| 4,817,950 | A * | 4/1989 | Goo | 463/36 |
| 5,524,637 | A * | 6/1996 | Erickson | 600/592 |
| 5,613,690 | A * | 3/1997 | McShane et al. | 273/449 |
| 6,876,496 | B2 * | 4/2005 | French et al. | 359/630 |
| 7,038,855 | B2 * | 5/2006 | French et al. | 359/630 |
| 7,357,766 | B2 * | 4/2008 | Langer et al. | 482/146 |
| 2008/0280740 | A1 * | 11/2008 | Knecht et al. | 482/146 |

* cited by examiner

*Primary Examiner*—Lori Baker
(74) *Attorney, Agent, or Firm*—Charles E. Baxley

(57) ABSTRACT

An interactive training device comprises an operation unit and an interaction unit. The operation unit has a movable plate built therein with a G-sensor so that motions of the movable plate in response to a user's operation are sensed by the G-sensor and further converted into particular signals to be output to the interaction unit.

5 Claims, 6 Drawing Sheets

INTERACTIVE TRAINING DEVICE

BACKGROUND OF THE INVENTION

1. Technical Field

The present invention relates to rehabilitation exercise devices, and more particularly, to an interactive training device, which comprises an operation unit and an interaction unit. In use, a user directly or indirectly operates the operation unit with his/her extremity voluntary movements. Then the operation unit performs motions in response to the movements and converts the motions into particular signals that are later transmitted to the interaction unit. While the interaction unit presents a simulation scene in a display, it receives and processes the signals output by the operation unit and converts the signals into an object moving in the scene corresponding to the motions of the operation unit.

2. Description of Related Art

Among various existing rehabilitation exercise devices operated by users' extremity voluntary movements, those for training users' balance are related to the present invention and will be described as a background of the technology implemented in the present invention.

In U.S. Pat. No. 4,509,743 (hereinafter referred to as '743 patent), a balance training apparatus comprises a base whereon a foot plate is supported by a plurality of springs disposed in a circular arrangement around a center of the foot plate so as to permit tilting of the foot plate relative to the base in all directions. Drive means is also provided for imparting a continuous irregular tilting movement to the foot plate. Thereby an athlete stands on the foot plate receives a balance training upon the tilting of the foot plate.

In U.S. Pat. No. 4,787,630 (hereinafter referred to as '630 patent), an exercise device includes a base assembly and a platform assembly supported by a bearing at a center of the base assembly for being stepped by a user. A semi-cylindrical rocker bar is provided at a bottom of the base assembly for contacting a horizontal physical surface so as to rock back and forth. When a user stands on the platform assembly, he/she can actively conduct a balance training by leaning his/her body in an irregular manner.

While '743 patent implements the active motions of the training apparatus to train a user to keep balance by passively shifting his/her center of body gravity, '630 patent uses a user's voluntary operation to operate the exercise device. However, neither '630 patent nor '743 patent involves a principle of "interactive visual-feedback control". Thus, users of those prior art devices are allowed of nothing but simply operating the devices, rendering exercise humdrum.

The so-called "interactive visual-feedback control" refers to a series of procedures including connecting an exercise device with an interaction unit, converting motions of the exercise device into particular signals, transmitting the particular signals to the interaction unit, receiving and processing the signals by a suitable software at the interaction unit wherein the software presents a simulation scene on a display for a user's viewing, and processing the signals with the software so as to convert the signals into movements of a dynamic object in the simulation scene, whereby a user can operate the exercise device according to situations shown in the simulation scene. Some prior exercise devices using the technology of "interactive visual-feedback control" will be briefly described below.

U.S. Pat. No. 4,817,950 (hereinafter referred to as '950 patent) provides a surfing simulator. Therein, a surfboard is supported by suspension system for allowing a user to stand thereon and control the same to tilt in all directions. Plural attitude sensors and switch modules are implemented to sense tilt directions and tilt angles of the surfboard. The attitude sensors and switch modules are connected to a computer terminal wherein a terminal display presents a simulated wave scene and a surfing figure controlled by the surfboard, so that a user can operate the surfboard to tilt along expected tilt directions for expected tilt angles for responding to the dynamic wave scene.

U.S. Pat. No. 5,613,690 (hereinafter referred to as '690 patent) relates to a balance training device, comprising a balance platform disposed on a base platform. The balance platform and the base platform are combined through a spherically shaped convex support and a spherically concave depression thereof, which form a low friction interface. The base platform is equipped with plural sensors and switches for sensing tilt directions of the balance platform. The sensors are linked to a personal computer or the like and providing a display of the angular displacement for the user on a computer monitor, through a suitable program.

Since '690 and '950 patents both use sensors and switches to sense the tilt movements of the surfboard or the balance platform, they have common defects due to the plural sensors and switches that complicate hardware structure of the devices and take up substantial space in the devices. Besides, in the aforementioned devices, the sensed data require complex computing processes and thus transmission lag tends to happen. Consequently, real-time reflection of the user's operation to the balance platform or the surfboard in its corresponding simulation scene may be impeded. Besides, while the sensors and switches are both sorts of passive sensing elements, insufficiency in location or in amount thereof can adversely affect the sensitivity and precision of the conventional training devices with respect to the tilt directions and tilt angles of such passive sensing elements.

SUMMARY OF THE INVENTION

A primary objective of the present invention is to provide an interactive training device comprising an operation unit and an interaction unit that are wirelessly communicated. In use, the operation unit generates motion signals and transmits the same to the interaction unit. While the interaction unit presents a simulation scene in a display, it receives and processes the motion signals so as to convert the motion signals into an object moving in the simulation scene. Thereby, a user can operate the interactive training device according to situations shown in the simulation scene and therefore exercise in an "interactive visual-feedback control" manner.

Another primary objective of the present invention is to provide an interactive training device containing a G-sensor (gravity sensor) built in an operation unit of the interactive training device for sensing movements of the operation unit in all directions and converting the same to particular signals that will be then transmitted to an interaction unit of the interactive training device. By using the G-sensor, needs for complex sensors, switch modules and wiring can be eliminated in the interactive training device while a high sensitivity of the interactive training device for promptly and accurately sensing the movements of the operation unit in all directions and accordingly conduct data processing as well as transmission so that the movements of the operation unit can be immediately reflected in the simulation scene.

Still another primary objective of the present invention is to provide an interactive training device wherein a function of "interactive visual-feedback control" is applied to a rehabilitation exercise device so as to amuse a user who uses the interactive training device to exercise and increase the user's willing to continue his/her rehabilitation exercise.

To achieve the above ends, the interactive training device of the present invention comprises an operation unit and an interaction unit. In use, a user directly or indirectly operates the operation unit with his/her extremity voluntary movement. Then the operation unit performs motions in response to the movement and converts the motions into particular signals that are transmitted to the interaction unit. While the interaction unit presents a simulation scene in a display, it receives and processes the signals output by the operation unit to convert the signals into movements of a dynamic object in the scene corresponding to the motions of the operation unit.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein.

DETAILED DESCRIPTION OF THE PREFERRED EMBODIMENT

While the present invention discloses an eyeglass assembly, it is to be understood that the accompanying drawings for being read in conjunction with the following embodiments are aimed to express structural features related to the characteristics of the present invention and thus are not, and do not need be, made in scale.

Figure 1:
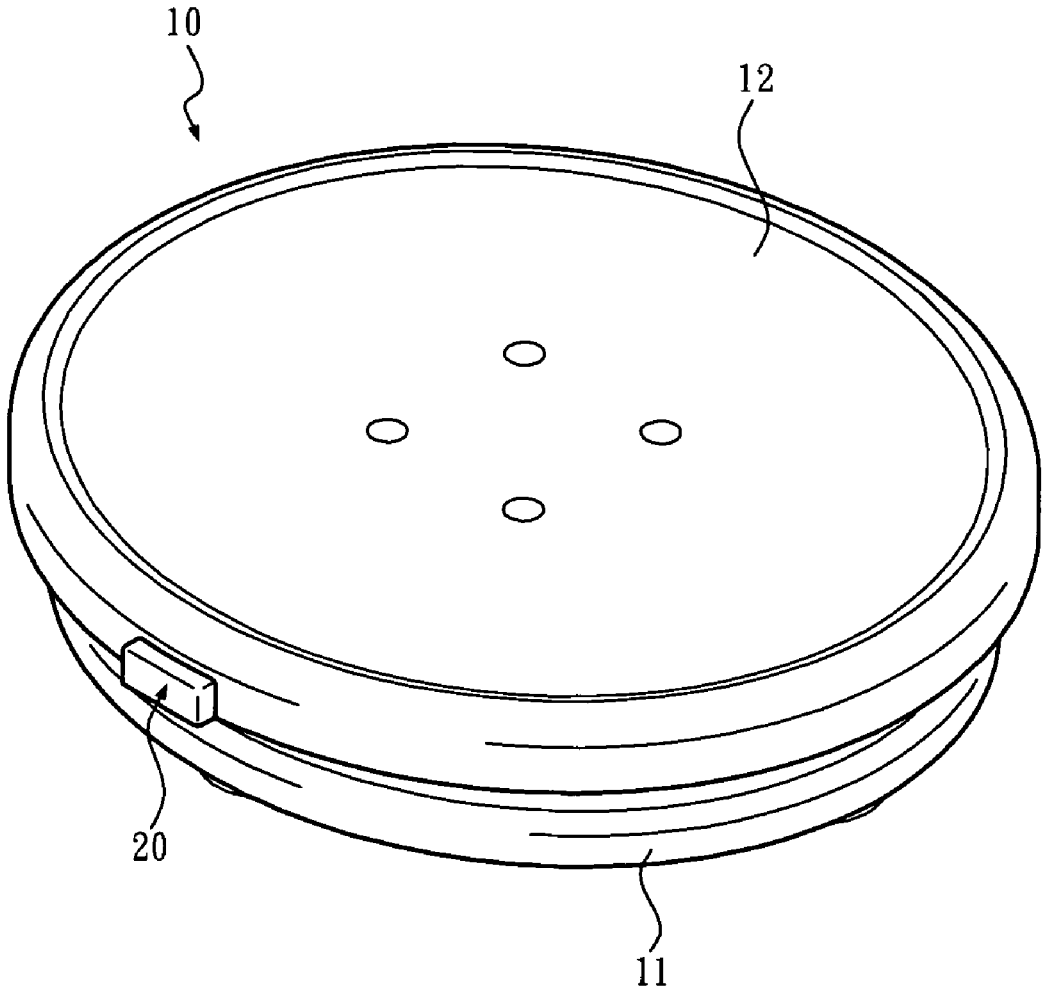
FIG. 1 is an oblique top elevation of an operation unit of the present invention.
Figure 2:
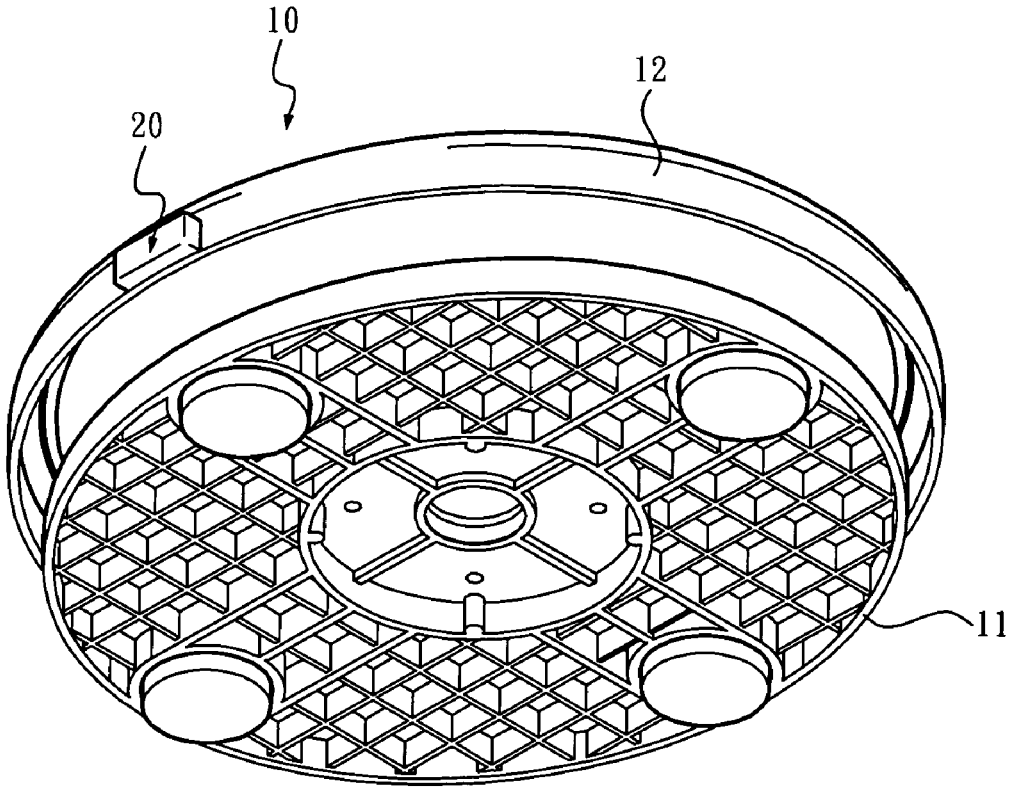
FIG. 2 is an oblique bottom elevation of the operation unit of the present invention.
Figure 3:
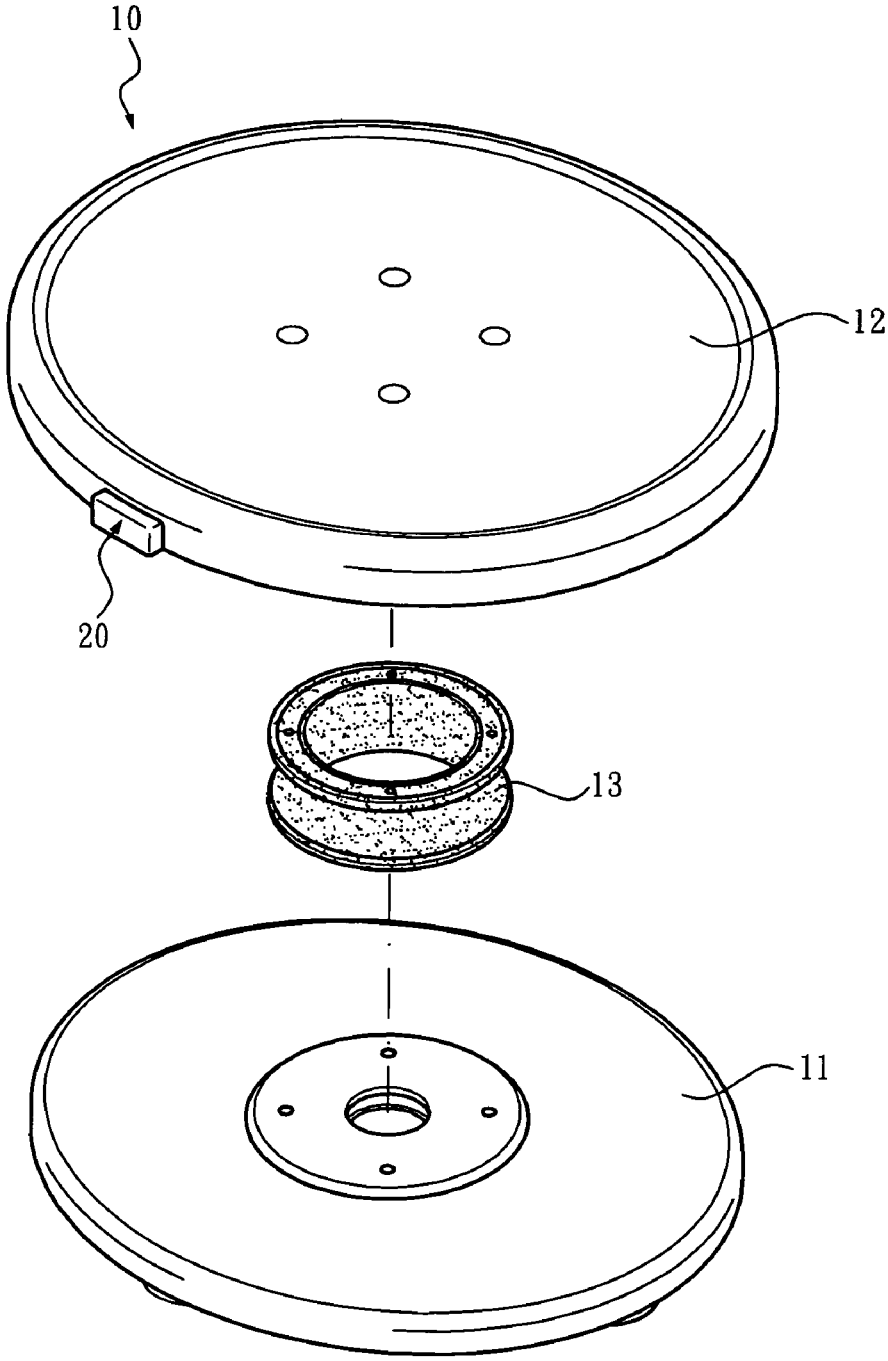
FIG. 3 is an exploded view of the operation unit of the present invention.
Figure 4:
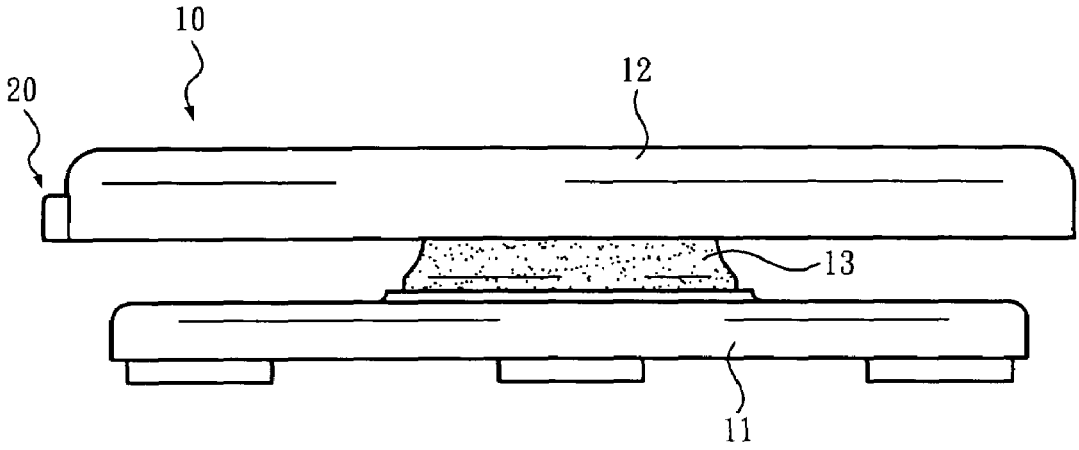
FIG. 4 is a lateral view of the operation unit of the present invention, showing the same in a balanced position.
Figure 5:
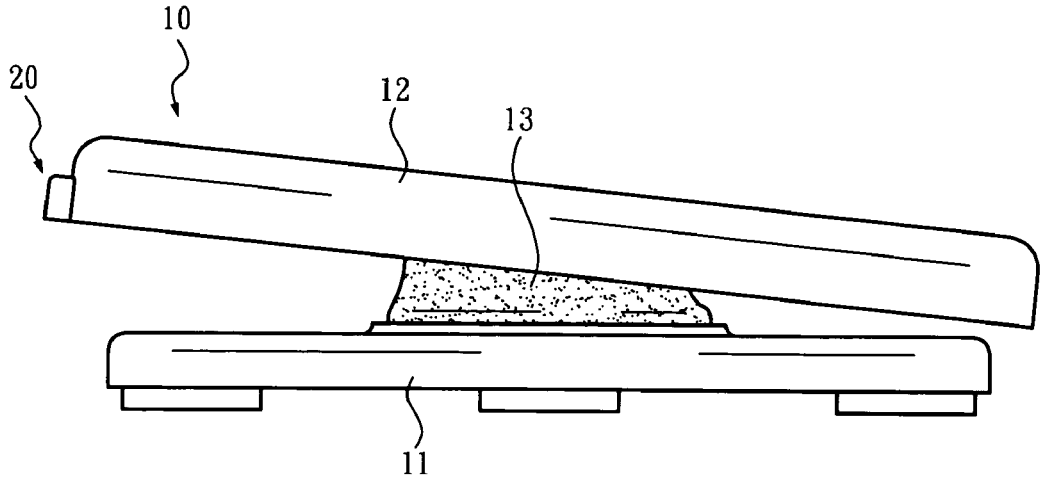
FIG. 5 is another lateral view of the operation unit of the present invention, showing the same in a tilted position.
Figure 6:
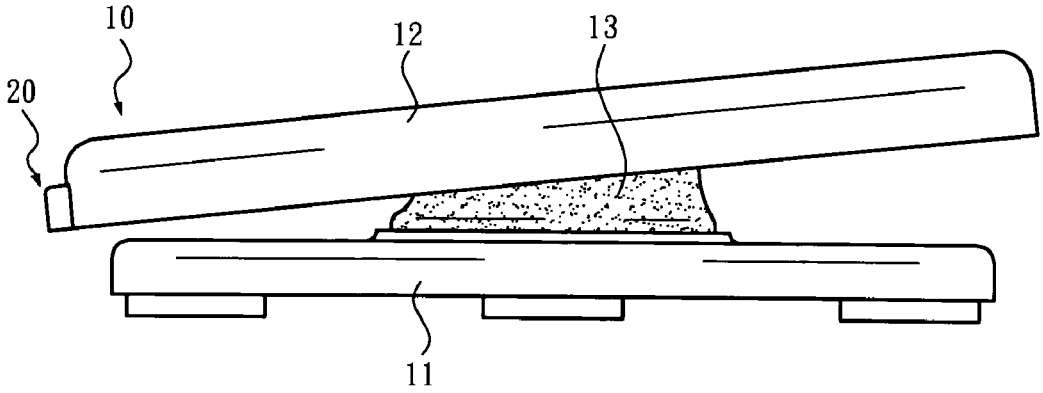
FIG. 6 is yet another lateral view of the operation unit of the present invention, showing the same in another tilted position.

FIGS. 1, 2 and 3 are perspective views of an operation unit 10 of the presently disclosed training device. The operation unit 10 comprises an immovable base 11, a movable plate 12, and a supporting member 13 fixed to the immovable base 11 for supporting the movable plate 12. The supporting member 13 may be any structure or mechanism that allows the movable plate 12 to perform multiple motions including tilt, slide and horizontal rotation. According to the present embodiment, the supporting member 13 is an elastomer fixed to the immovable base 11 and supporting the movable plate 12 at a central region of the movable plate 12. The elastomer, which is made of rubber and formed as a column, enable the movable plate 12 to stay at a balanced position normally (as shown in FIG. 4), to shift to tilted positions in response to downward deflecting forces acting thereon (as shown in FIGS. 5 and 6), and to resiliently return to the normal balanced position when the deflecting force is withdrawn from the movable plate 12. The elastomer allows the movable plate 12 to tilt in all directions.

Figure 7:
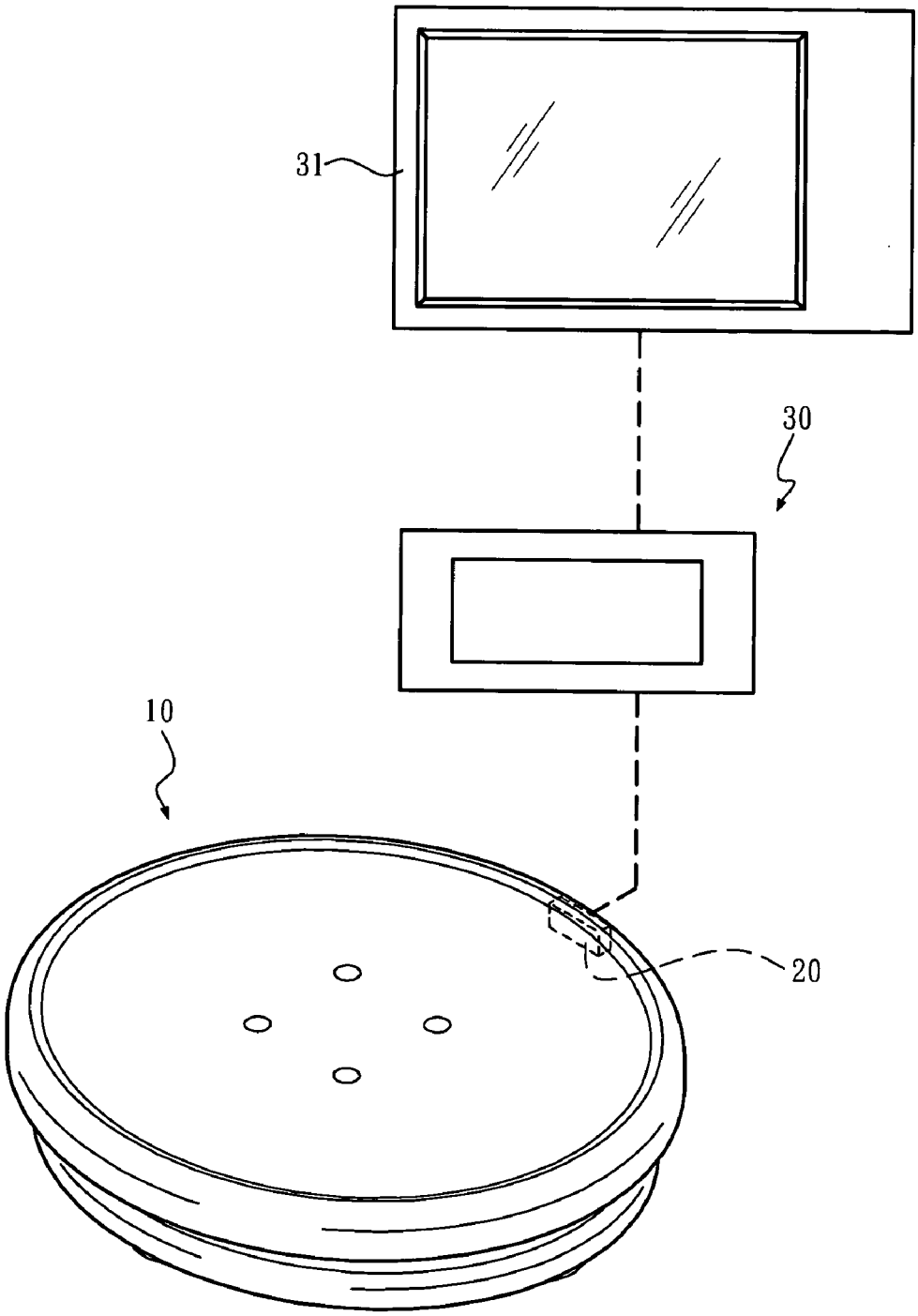
FIG. 7 is schematic drawing showing an interactive training device of the present invention constructed from connecting the operation unit with an interaction unit.

The operation unit 10 of the present invention further comprises a G-sensor 20 built in the movable plate 12 for sensing and determining directions, angles and speeds of the motions of the movable plate 12 wherein the motions may include tile, slide, horizontal rotation and more. In the depicted embodiment, since the movable plate 12 is supported by the supporting member 13, the G-sensor 20 primarily serves to sense the tilt direction and tilt angle of the movable plate 12. The G-sensor 20 further processes the sensed tilt direction and tile angle into particular signals that are then converted and output to an interaction unit 30 by a specific circuit or program, as illustrated in FIG. 7. While the interaction unit 30 presents a simulation scene in a display 31, it receives and processes the signals to convert the signals regarding to the tilt direction and tile angle of the movable plate 12 into movements of a dynamic object in the scene corresponding to the motions of the operation unit 10 so that a user can operate the movable plate 12 according to situations shown in the simulation scene, thereby taking exercise in an "interactive visual-feedback control" manner.

The movable plate 12 of the operation unit 10 may be combined with a structure or mechanism of a rehabilitation exercise device wherein the structure or mechanism can be operated by a user to conduct motions of swing, tilt, shift, rotation or slide. For example, the movable plate 12 of the operation unit 10 may be combined with a balancing board of a standing balance training machine whereupon a user can be on his/her legs so as to provide the balance training machine with the function of "interactive visual-feedback control". In another instance, a joy stick of a hand training machine for being operated by a user's hand, may be combined with the movable plate 12 of the operation unit 10 of the present invention so that the hand training machine is provided with the function of "interactive visual-feedback control".

Although the particular embodiment of the invention has been described in detail for purposes of illustration, it will be understood by one of ordinary skill in the art that numerous variations will be possible to the disclosed embodiments without going outside the scope of the invention as disclosed in the claims.

What is claimed is:

1. An interactive training device for rehabilitative exercise comprising:

an operation unit comprising:

an immovable base supported on a ground surface;

a movable plate positioned above said base and movable for tilting, sliding and horizontal rotation;

an elastomeric supporting member, fixed to said immovable base at a central region on a top surface of said base and disposed for supporting said movable plates; and, a gravity sensor integrated within said movable plate and wherein said gravity sensor is disposed to sense tilt direction and tilt angle motion of said movable plate and to convert and transmit said sensed motion into signals;

an interaction unit for interactive visual feedback comprising;

a display having a presentation screen;

electrical connections connecting said display and said gravity sensor wherein said connections process and convert said signals into movements of a dynamic object which are transmitted and displayed on said presentation screen while a user stands upon said device.

2. The interactive training device for rehabilitative exercise of claim 1 wherein, the supporting member allows the movable plates to tilt in all directions with respect to the supporting member and then return to an initial position.

3. The interactive training device for rehabilitative exercise of claim 2, wherein the elastomer is made of rubber and comprises a column.

4. The interactive training device for rehabilitative exercise of claim 1 wherein, the supporting member allows the movable plates to horizontally rotate in both directions.

5. The interactive training device for rehabilitative exercise of claim 1 wherein said electrical connections comprise:

wireless connections.

* * * * *